United States Patent [19]

Mukai et al.

[11] Patent Number: 4,769,676

[45] Date of Patent: Sep. 6, 1988

[54] IMAGE FORMING APPARATUS INCLUDING MEANS FOR REMOVING RESIDUAL TONER

[75] Inventors: Hideo Mukai; Takashi Shimazaki, both of Yokohama; Goro Oda, Sagamihara, all of Japan

[73] Assignee: Kabushiki Kaisha Toshiba, Kawasaki, Japan

[21] Appl. No.: 20,715

[22] Filed: Mar. 2, 1987

[30] Foreign Application Priority Data

Mar. 4, 1986 [JP] Japan ..... 61-45178
Mar. 4, 1986 [JP] Japan ..... 61-45179

[51] Int. Cl.[4] ..... G03G 21/00

[52] U.S. Cl. ..... 355/15; 355/3 DD; 118/652

[58] Field of Search ..... 355/3 DD, 15, 3 R; 118/652, 653, 661; 430/125

[56] References Cited

U.S. PATENT DOCUMENTS 3,625,683 12/1971 Emerson ..... 355/15 X
3,646,866 3/1972 Baltazzi et al. ..... 355/15
3,649,262 3/1972 Cade et al. ..... 355/15 X
3,754,962 8/1973 Berlier et al. ..... 355/15 X
4,265,998 5/1981 Barkley ..... 430/125
4,545,669 10/1985 Hays et al. ..... 355/3 BE
4,609,280 9/1986 Queener ..... 355/15 X
4,664,504 5/1987 Oda et al. ..... 355/15

*Primary Examiner*—R. L. Moses
*Attorney, Agent, or Firm*—Foley & Lardner, Schwartz, Jeffery, Schwaab, Mack, Blumenthal & Evans

[57] ABSTRACT

An image forming apparatus comprises an image carrier, a main charger for charging the image carrier, an exposure unit for exposing the image carrier to form a latent image thereon, developing unit for developing the latent image to form a developed image on the image carrier with a developing agent, the developing unit is provided so that there is a gap between it and the image carrier, and a transferring charger for transferring the developed image onto a sheet-like material. A bias voltage is applied across the developing unit and image carrier to cause the developing agent to transfer from the developing unit to the latent image via the gap, and to cause the residual developing agent remaining on the image carrier after the developed image transferring by the transferring charger to transfer to the developing unit via the gap.

18 Claims, 10 Drawing Sheets

IMAGE FORMING APPARATUS INCLUDING MEANS FOR REMOVING RESIDUAL TONER

BACKGROUND OF THE INVENTION

1. Field of the Invention

The present invention relates to an image forming apparatus which has a developing section in which single-component developing agent is caused to attach to the electrostatic latent image formed on an image carrier without the developing section and the image carrier contacting each other.

2. Description of the Related Art

In copying apparatus or laser printers which utilize the electrophotographic recording process such as shown in FIG. 1, the apparatus forms a copy image on copying paper 16 by devices such as a charging device 11, an exposure device 12, a developing device 13 and a image transferring device 14 being provided around a photosensitive drum 10. At the same time, this apparatus removes any residual toner on photosensitive drum 10 after image transferring by a contact type cleaning device 17 having of a cleaning blade 17*a*.

However, in image forming apparatuss such as this, apart from developing device 13, cleaning device 17 must also be provided in a position opposite to it. For this reason, from the viewpoint of the image forming process, restrictions will occur in the positions of installation of such other devices as exposure device 12 and image transferring device 14. Thus, the degree of freedom in design is reduced and, at the same time, there is the drawback that the surface of photosensitive drum 10 will be worn by friction with cleaning blade 17*a* when cleaning, causing deterioration of its properties and reducing its life. Moreover, ozone products are produced in charging device 11, when charging, and since deterioration occurs in negative polarity organic photoconductor (hereafter OPC) due to these ozone products, ozone products which are produced to excess must be instantly exhausted. However, there is a problem in that this exhaust route is blocked by cleaning device 17. Also, there are problems of disposal of toner collected in cleaning device 17 and of maintenance being difficult and, at the same time, of soiling occurring in the vicinity. For this reason, apparatus were developed which, after developing for the 1st revolution of the photosensitive drum using a developing device, would carry out cleaning on the 2nd revolution of the photosensitive drum using the same developing device. However, although a device exclusively for cleaning is not required in such apparatus, since the developing process and the cleaning process are carried out separately, a photosensitive drum is required of greater (longer) circumference than the length of the image to be formed. Thus, there is the drawback that miniaturisation of the photosensitive drum, and therefore of the apparatus as a whole, is prevented. Moreover, in recent years, apparatus have been developed such as U.S. patent application Ser. No. 571,800, now U.S. Pat. No. 4,664,504 (filed on Jan. 18, 1984) which carry out the developing process and the cleaning process simultaneously by a single developing device. However, this apparatus carry out developing and cleaning using a two-component developing agent having toner and carrier particles as the developing agent. Consequently, they have problems in that the developing device itself is both bulky and heavy, and also their cost rises because of the necessity of using the controller for automatic controlling the toner density. Furthermore, if the potential difference between the unexposed areas of the photosensitive body and the developing roller is increased too far when trying to ensure collection of the residual toner, since the carrier particles has the opposite potential to the toner it is liable to drawn from the developing roller to the photosensitive body. Also, since the resistance of carrier particles is lower than that of the toner, the carrier particles are liable to be charged with the opposite polarity charge to that of the toner by high electric fields. Consequently, there are such problems as deterioration of the photosensitive body and reduction of the image quality because of adherence of the carrier particles to the photosensitive body.

SUMMARY OF THE INVENTION

It is an object of the present invention to provide an improved image forming apparatus which has the degree of freedom in the design of the apparatus and thus miniaturisation and reduction of weight and cost can be designed, also, deterioration of the image carrier can be prevented and long life can be achieved.

It is another object of the present invention to provide an image forming apparatus in which sharp images can be obtained.

It is further object of the present invention to provide an image foring apparatus in which the maintainability is improved by no need to dispose of the collected toner.

According to a first aspect of the present invention, there is provided an image forming apparatus including:

an image carrier:

means for charging the image carrier;

means for exposing the image carrier to form a latent image thereon;

means for developing the latent image to form a developed image on the image carrier with a developing agent, the developing means is provided so that there is a gap between it and the image carrier;

means for transferring the developed image onto a sheet-like material; and means for applying a bias voltage to the developing means to causes the developing agent to transfer from the developing means to the latent image via the gap, and to causes the residual developing agent remaining on the image carrier after the developed image transferring by the transferring means to transfer to the developing means via the gap.

According to a second aspect of the present invention, there is provided an image forming apparatus including:

an image carrier:

means for charging the image carrier;

means for exposing the image carrier to form a latent image thereon;

means for developing the latent image to form a developed image on the image carrier with a developing agent;

means for transferring the developed image onto a sheet-like material; and means for distributing the residual developing agent remaining on the image carrier after the developed image transferring by the transferring means and before next image forming process.

According to a third aspect of the present invention, there is provided an image forming apparatus including:

an image carrier:

means for charging the image carrier;

means for exposing the image carrier to form a latent image thereon;

means for casing a developing agent therein;

means for developing the latent image to form a developed image on the image carrier with the developing agent, the developing means is provided in the casing means and so that there is a gap between it and the image carrier;

means for transferring the developed image onto a sheet-like material;

means for cleaning the residual developing agent remaining on the image carrier, the cleaning means is provided in the casing means and so that there is a gap between it and the image carrier, and the cleaning means positioned between the exposing means and developing means;

first means for applying a bias voltage to the developing means to causes the developing agent to transfer from the developing means to the latent image via the gap; and second means for applying a bias voltage to the cleaning means to causes the residual developing agent remaining on the image carrier after the developed image transferring by the transferring means to transfer to said cleaning means via the gap.

BRIEF DESCRIPTION OF THE DRAWINGS

FIGS. 2 to 5 show a first embodiment of the present invention, in which:

FIG. 2 is a schematic view showing an image forming apparatus;

FIG. 3 is a timing chart showing the timings of an image forming process;

FIG. 4 is a representation showing an image forming processes according to the apparatus shown in FIG. 2;

FIG. 5 is a representation showing the principle of transferring of toner;

FIGS. 6 to 8 show a second embodiment of the present invention, in which:

FIG. 6 is a schematic view showing an image forming apparatus;

FIG. 9 is a graph showing the developing characteristic of the developing device;

FIG. 10 is a graph showing the toner collection characteristic of the developing device;

FIGS. 12 to 15 show a third embodiment of the present invention, in which:

FIG. 12 is schematic view showing an image forming apparatus;

FIG. 13 is a timing chart showing the timings of an image forming process;

FIG. 14 is a representation showing an image forming processes according to the apparatus shown in FIG. 12; and FIG. 15 is a representation showing the principle of transferring of toner.

DETAILED DESCRIPTION OF THE PREFERRED EMBODIMENTS

One of the preferred embodiments of the present invention will be described with reference to the accompanying drawings.

Figure 1:
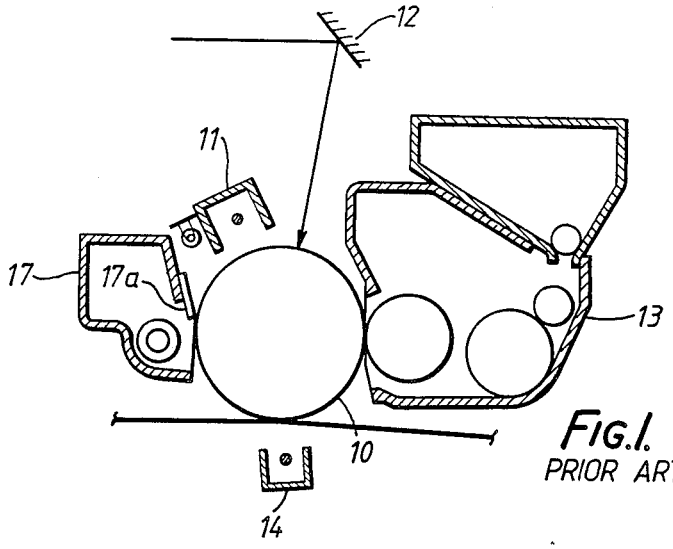
FIG. 1. PRIOR ART
FIG. 1 is a schematic view showing an image forming apparatus in a prior art.
Figure 2:
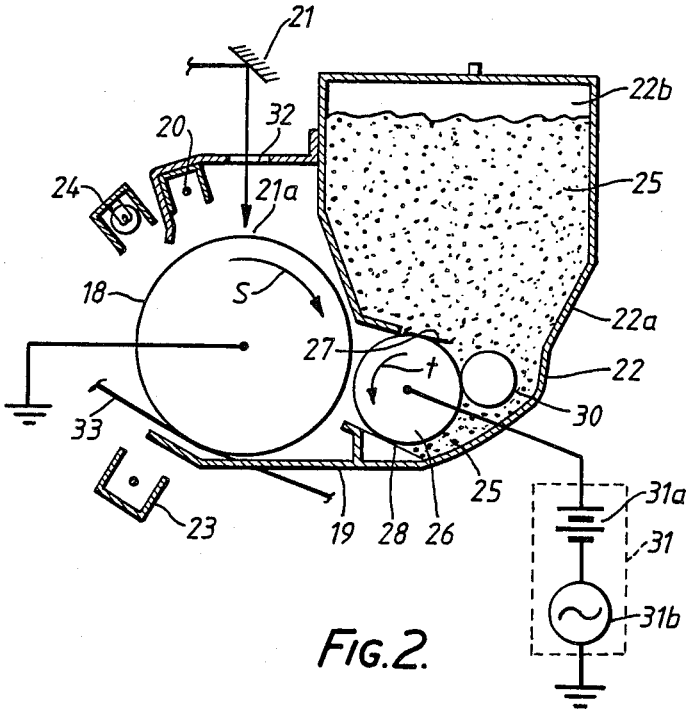

FIG. 2 schematically shows a laser beam printer as an image forming apparatus according to a first embodiment of the present invention. A photosensitive drum 18 having 30 [mm] diameter and a positive polarity organic photoconductor (OPC) layer as a photosensitive layer and serving as an image carrier is so disposed in a main body (not shown) as to be rotatable clockwise. Photosensitive drum 18 is electrically grounded. A main charger 20, an exposure section 21*a*, a developing device 22, a transferring charger 23 and a discharging lamp 24 are provided in succession around photosensitive drum 18. Main charger 20 uniformly charges the surface of photosensitive drum 18 with +900 [V]. Exposure section 21*a* is irradiated with a laser beam in accordance with image information by an exposure device 21. Developing device 22 performs simultaneously developing and cleaning of photosensitive drum 18. Transferring charger 23 serves to transfer the developed image on photosensitive drum 18 onto a paper sheet 33. Discharging lamp 24 irradiates light to remove the residual charge on photosensitive drum 18. Main charger 20, exposure section 21a and developing device 22 are housed in a unit 19. At developing device 22, toner 25 which is a non-magnetic single-component developing agent is supplied to developing roller 26 from a toner hopper 22*b* inside a casing 22*a*.

The non-magnetic single-component developing agent used for this apparatus as toner 25 is comprised, for example, a specific unsaturated polyester resin and carbon pigment disparsed in the resin. No magnetic material is disparsed in the resin to non-magnetize the developing agent. Further, no carrier particles are mixed with toner 25.

Developing roller 26 is 16 [mm] in diameter and is composed of an aluminium sleeve which is sand-blasted and electroless nickel-plated and has a surface roughness of 0.1–5 [μm] in order to increase its surface strength. Developing roller 26 is positioned so that there is a gap of 250 [μm] between it and photosensitive drum 18. Moreover, a coating blade 27 for forming a thin layer of toner 25 on developing roller 26, a sealing blade 28 for sealing toner 25 after developing and a roller 30 which scrapes off toner 25 from developing roller 26 are provided in sliding contact around developing roller 26. Coating blade 27 is made of phosphor bronz and has 0.2 [μm] thickness. Sealing blade 28 is made of Mylor (trade name of Du Pont) and has 100 [μm] thickness. Furthermore, a power source 31 is applied across developing roller 26 and photosensitive drum 18. Power source 31 comprises a direct-current power source 31a generating a direct-current voltage of +400 [V] and an alternating-current power source 31*b* generating an alternating-current voltage of frequency 2 [KHz] and peak-to-peak 1.6 [KV]. Therefore, a voltage, in which a direct-current voltage of +400 [V] and an alternating-current voltage of frequency 2 [KHz] and peak-to-peak 1.6 [KV] are superimposed, is applied across developing roller 26 and photosensitive drum 18. Numeral 32 denotes a window which is formed in unit 19 to permit the passage of the laser beam from exposure device 21.

Figure 3:
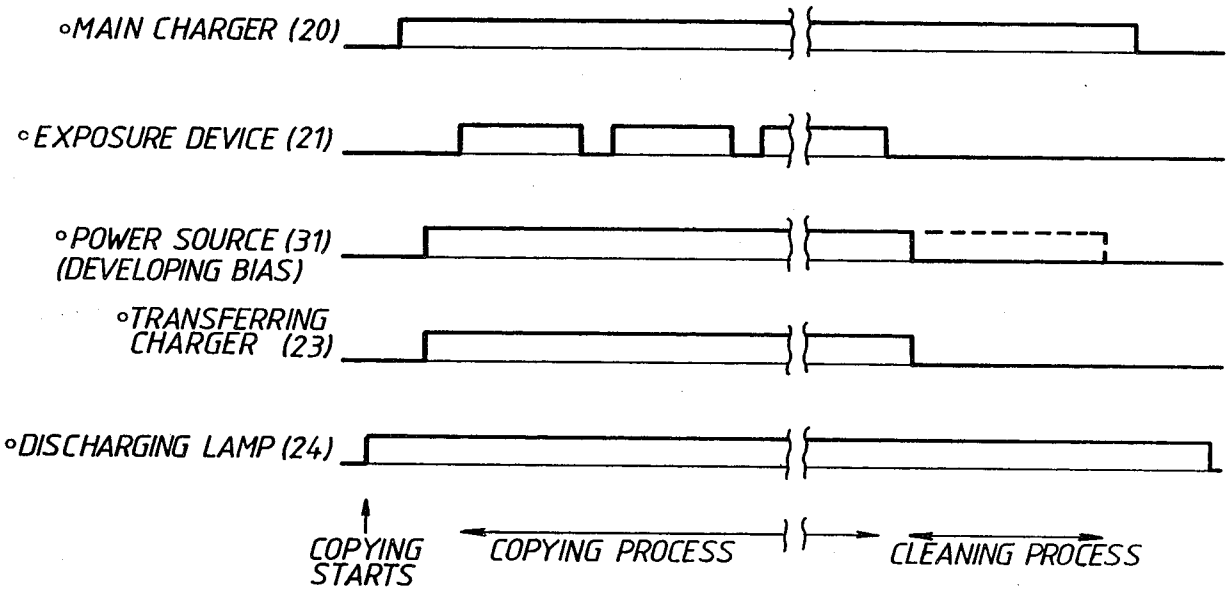
Figure 4:
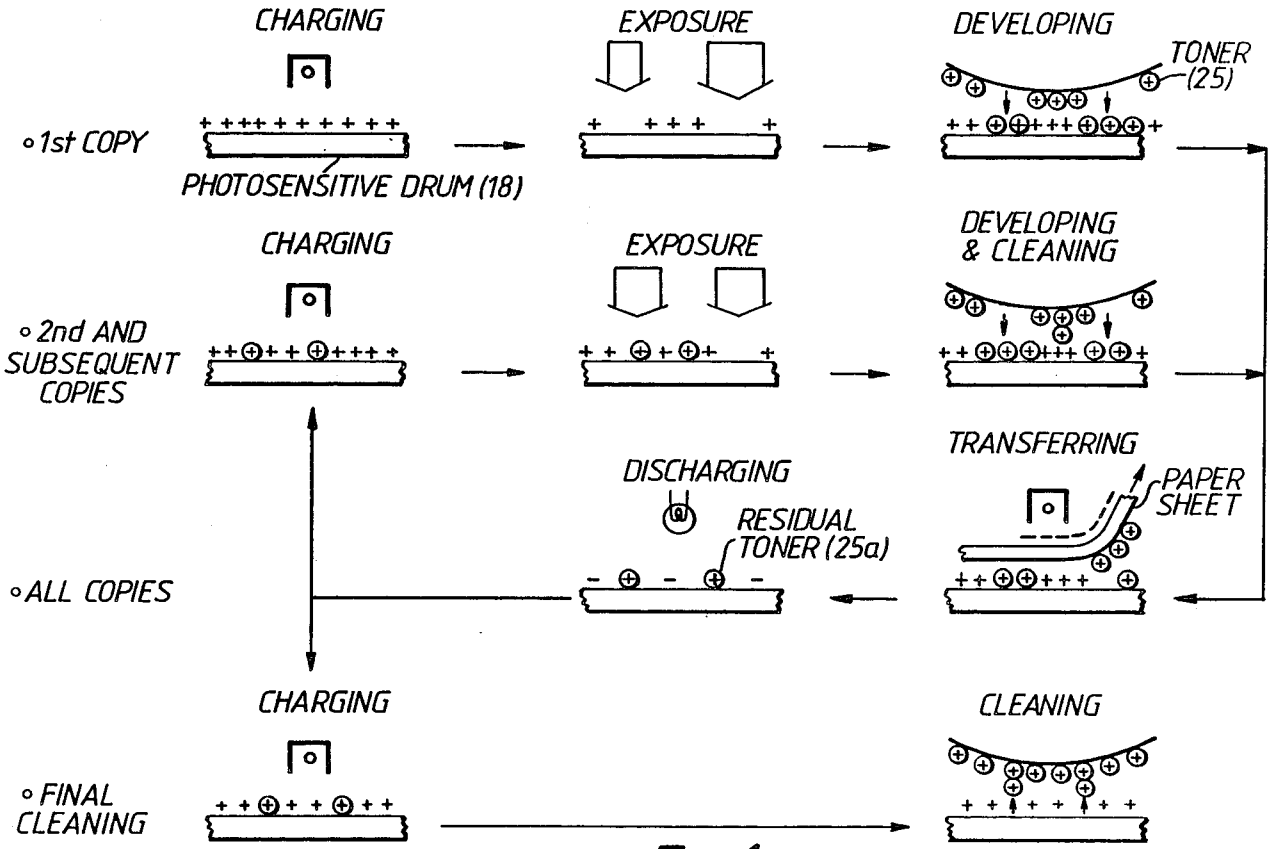
Figure 5:
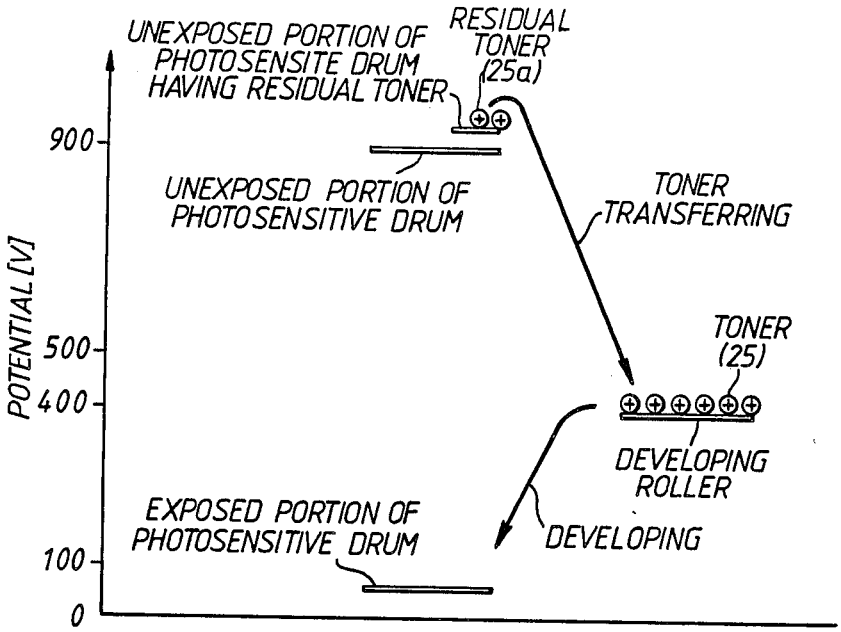

Next, the operation is described. As shown in the timing chart in FIG. 3, when copying is started, photosensitive drum 18 is rotated in the direction of arrow S in order to make the first copy and, at the same time, discharge lamp 24 is lit and each part of the image forming apparatus is operated. That is, as shown in FIG. 4, the surface of photosensitive drum 18 is uniformly charged with +900 [V] by main charger 20 while photosensitive drum 18 rotates. Then, at exposure section 21*a*, photosensitive drum 18 is exposed by the laser beam according to the image information, and an electrostatic latent image is formed on photosensitive drum 18. That is, the electrostatic latent image comprises an image area corresponding to exposed areas reducing to +70 [V] and a non-image area corresponding to unexposed areas maintaining +900 [V]. After this, developing device 22 is reached and, at this time, developing roller 26 is rotated in the direction of arrow t and its surface is formed a thin layer of toner 25 by sliding contact with coating blade 27. At this time, the toner is charged with the same polarity as that of photosensitive drum 18, which in this case is positive, and a direct-current voltage of +400 [V] is applied across developing roller 26 and photosensitive drum 18 as a bias voltage and, at the same time, toner 25 is made ready to vibrate and transfer by the applying of an alternating-current voltage. Moreover, since a potential difference is 330 [V] between the direct-current component of the bias voltage applied to developing roller 26 and the surface potential of the exposed areas of photosensitive drum 18 is sufficient for toner 25 to transfer from developing roller 26 to the exposed areas of photosensitive drum 18 via the gap, as a result, a developed image is formed on photosensitive drum 18. Next, the developed image on photosensitive drum 18 is transferred on to paper sheet 33 by transferring charger 23. After this, paper sheet 33 is discharged to the outside of the main body via a fixing device (not shown). At the same time, the whole surface of photosensitive drum 18 is irradiated by discharge lamp 24, the image forming process for the first copy is completed and the second copy is commenced. However, although some toner still remains on photosensitive drum 18 at this stage, this residual toner 25*a* is only about 10% of the toner amount when forming the developed image on photosensitive drum 18 (i.e., developing) and, even at the second copy stage, will cause no adverse effect on carrying out the charging and exposure processes. Consequently, as shown in FIG. 4, the whole surface of photosensitive drum 18, including the section where there is residual toner 25*a*, is uniformly charged to +900 [V] in the same way as for the first copy while photosensitive drum 18 rotates. Moreover, it is exposed at exposure section 21*a* in accordance with the image information. Regardless of whether there is any residual toner 25*a* or not, the surface potential of the unexposed areas is maintained at +900 [V] while, at the same time, the surface potential of the exposed areas is reduced to +70 [V]. This is because, at the time of exposure the laser beam irradiates thoroughly right through residual toner 25*a* and, at the same time, the excess charge which is given to residual toner 25*a* when charging leaks away due to reduction of the resistance of photosensitive drum 18 below residual toner 25*a*. Thus, when photosensitive drum 18 reaches developing device 22, the potential difference between the direct-current component of the bias voltage applied to developing roller 26 and the surface potential of exposed areas on photosensitive drum 18 becomes 330 [V] in the same way as in the case of the first copy. Consequently, toner 25 on developing roller 26 is caused to transfer to the exposed areas of photosensitive drum 18 via the gap and thus developing of photosensitive drum 18 can be carried out. Incidentally, even if there is residual toner 25*a* on the exposed areas, this residual toner 25*a* will be buried in toner 25 due to the fresh developing. At the same time, since the potential difference between the unexposed areas of photosensitive drum 18 and the direct-current component of the bias voltage applied to developing roller 26 is 500 [V], as shown in FIG. 5, residual toner 25*a* on the unexposed areas of photosensitive drum 18 transfers to developing roller 26 via the gap, as a result, photosensitive drum 18 is cleaned off so that no fogging occurs on the second copy image.

Photosensitive drum 18, on which developing in respect of the second copy and cleaning in respect of the first copy have been carried out simultaneously by developing device 22, is discharged by discharge lamp 24 after image transferring has been carried out by transferring charger 23 in the same way as for the first copy, and copying of the next copy commences. After this, the above mentioned processes are repeated until the required number of copies are made. When the last copy has been completed, as shown in FIG. 3, the operations of exposure device 21 and transferring charger 23 are stopped, but main charger 20 and discharge lamp 24 continue to operate. On the other hand, the direct-current component of power source 31 becomes zero and only the alternating-current voltage is applied to developing roller 26 so that cleaning of photosensitive drum 18 can be carried out. That is, as shown in FIG. 4, the surface of photosensitive drum 18 is charged uniformly with +900 [V] by main charger 20 while photosensitive drum 18 rotates. Next, since photosensitive drum 18 reaches developing device 22 without having been exposed and also without the direct-current component of the bias voltage having been applied to developing roller 26, the potential difference of direct-current component between photosensitive drum 18 and developing roller 26 is 900 [V]. All residual toner 25*a* on photosensitive drum 18 transfers back to developing roller 26 and thus photosensitive drum 18 is cleaned. Then, when photosensitive drum 18 passes discharge lamp 24, the whole process is completed and the operations of main charger 20, developing device 22, discharge lamp 24 and photosensitive drum 18 are stopped.

According to the first embodiment described above, developing and removing of residual toner 25*a* on photosensitive drum 18 can be carried out simultaneously by developing device 22 even without providing a device exclusively for cleaning in a position opposite to developing device 22. Thus, the degree of freedom in design is improved and miniaturisation and weight reduction of the apparatus can be more easily designed and, at the same time, there is no hindrance to an exhaust passage for ozone products generated from main charger 20. Thus, for instance, even when an OPC of negative polarity is used, there is no danger of deterioration of the OPC due to ozone products. Moreover, there is no requirement for disposal of removed toner in the developing device so that maintainability is improved. On the other hand, even in comparison with apparatuses which carry out the developing and cleaning processes simultaneously using two-component developing agents, the developing device, and therefore the image forming apparatus, can be miniaturised and reduced in weight. At the same time, a sharp copy image can be obtained without the occurrence of the carrier particles transferring to the photosensitive drum 18, and without risk of deterioration of photosensitive drum 18 or soiling of images.

Figure 6:
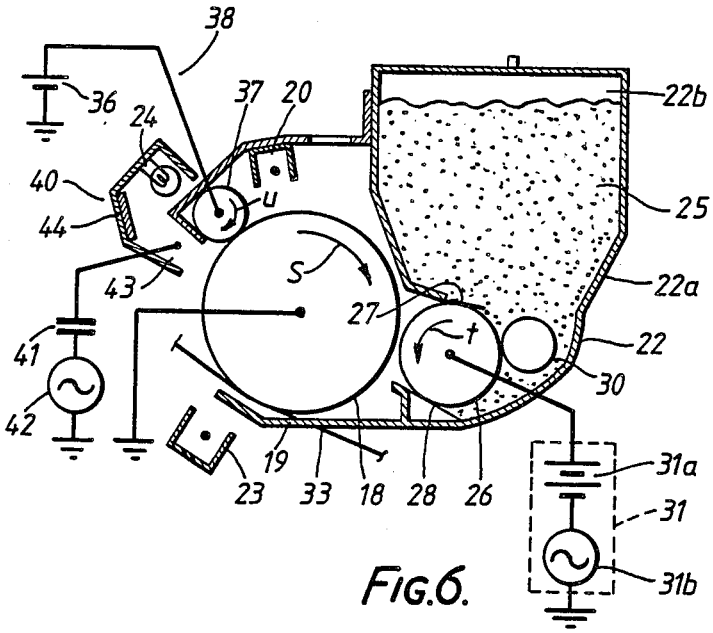

Next, a second embodiment of the present invention is described with reference to FIGS. 6–8. The same notation is used for those parts which are the same as in the first embodiment and their descriptions have been omitted. This apparatus has a distribution device 38 positioned before main charger 20 composed of a distribution roller 37 which is formed by an acrylic brush having fur length 4 [mm] in the shape of a roller. A voltage of +500 [V] of the same polarity as that of the toner is applied to distribution roller 37 by direct-current power source 36. Also, in order to make the surface potential of photosensitive drum 18 and the charge of the residual toner zero, there is a discharge device 40 which, together with discharge lamp 24, is applied with an alternating-current voltage by an alternating-current power source 42 which is connected to 0.2 [μF] condenser 14, and a discharge charger 43 which discharges so that the positive and negative coronas are balanced. A mirror 44 conducts the light from discharge lamp 24 onto photosensitive drum 18.

Figure 7A:
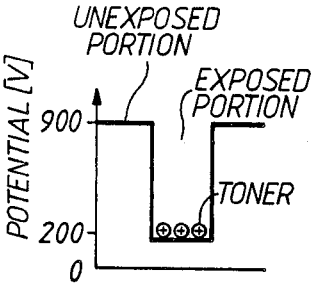
FIG. 7A is a graph showing the surface potential of an image carrier before image transferring operation.
Figure 7B:
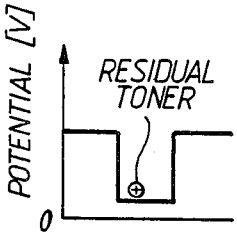
FIGS. 7B and 7C are graphs showing surface potentials of an image carrier after image transferring operation.
Figure 7C:
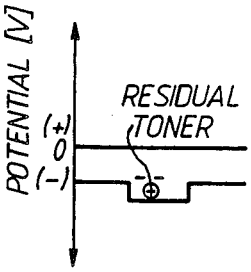
Figure 8A:
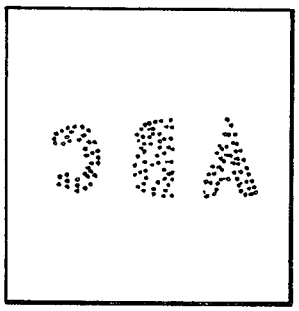
FIG. 8A is a plan view showing the residual developed image immediately after image transferring operation.
Figure 8B:
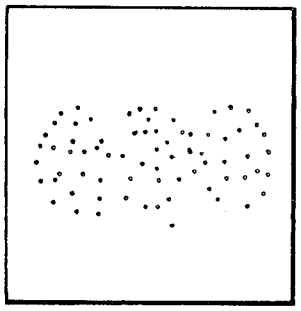
FIG. 8B is a plan view showing the residual toner after depatterning of the residual developed image.
Figure 9:
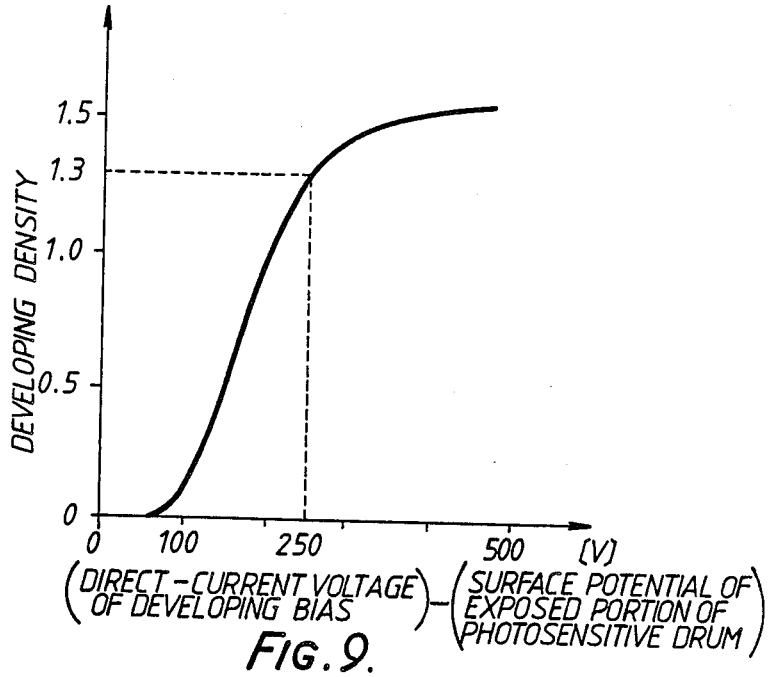
FIGS. 9 and 10 show characteristics of the embodiments of the present invention.
Figure 10:
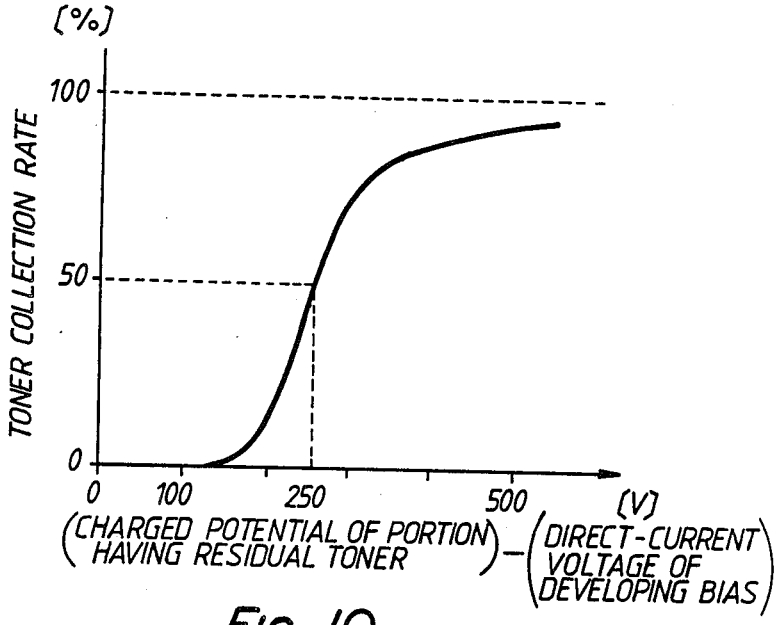

In this apparatus the processes from charging to image transferring are carried out in exactly the same way as in the first embodiment until discharge device 40. When this process is reached to discharge device 40, the surface potential of photosensitive drum 18 differs according to the atmospheric conditions when image transferring, and also according to the thickness and quality of paper sheer 33. That is, before image transferring, as shown in FIG. 7A, for the surface potential of photosensitive drum 18. although the state of the unexposed areas is the same as at the time of charging, the exposed areas is increased by 100 [V] more than at the time of exposure due to the adhesion of toner 25. When image transferring, if the negative charge which flows through paper sheet 33 to photosensitive drum 18 is small, depending on the type of paper sheet 33, only the surface potential of the whole of photosensitive drum 18 will be reduced, as shown in FIG. 7B. As opposed to this, if the negative charge which flows through paper sheet 33 to photosensitive drum 18 is large, depending on the type of paper sheet 33, the surface potential of photosensitive drum 18 will invert to negative polarity, as shown in FIG. 7C. Consequently, photosensitive drum 18 will reach discharge device 40 in the state shown in FIG. 7B or 7C. However, discharge device 40 is used in conjunction with discharge lamp 24 and discharge charger 43 and, moreover, alternating-current power source 42 of discharge charger 43 is connected to condenser 41. Since these normally operate to make their subject, photosensitive drum 18, 0 [V], in whichever of the states in FIGS. 7B and 7C the surface potential of photosensitive drum 18 is, they guarantee that the charge on photosensitive drum 18 and residual toner **25*a* is zero. By this means, residual toner 25*a* is not bound to the photosensitive body and it arrives at distribution device 38 in a highly mobile state. There, it comes into sliding contact with distribution roller 37 which rotates in the direction of arrow u and the residual toner on photosensitive drum 18 is depatterned from the state shown in FIG. 8A to that shown in FIG. 8B, and in this state the next new image forming process is commenced. Moreover, at this time, since a voltage of +500 [V] is applied to distribution roller 37 there is no risk that residual toner 25*a* will adhere to distribution roller 37** due to a charge generated by friction.

When constructed in this way, after residual toner **25*a* has been collected by developing device 22, even if, say, some residual toner 25*a* remains on photosensitive drum 18, it will not affect resolution of copied image by creating an after-image on the next copy. The most that may happen is that some overall fogging will occur. Moreover, by applying a positive voltage, residual toner 25*a* will not adhere to strewing roller 37 even though it is in sliding contact with residual toner 25*a* and, since there is no need to replace strewing roller 37** or to dispose of the collected toner, there is no disadvantage to maintainability.

Incidentally, this invention is not confined to the embodiments, and many modifications of design are possible. For example, with regard to the gap between photosensitive drum 18 and developing roller 26, this is arbitrary providing the developing and cleaning processes are possible, but preferably it should be of the order of 150–500 [μm]. Also, the developing device is not limited to that in this invention. The object of the present invention can be accomplished with, provided it is a non-contact developing device and developing and cleaning can be carried out simultaneously. For example, even if a magnetic toner is used, it is only a matter of altering the conditions according to the magnetic force and then the same result can be achieved.

Figure 11:
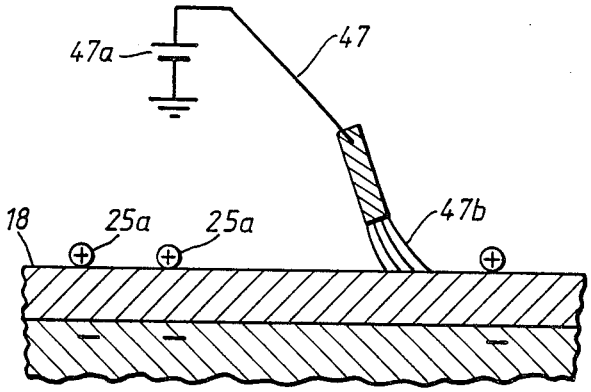
FIG. 11 is a partial cross-section view showing the depatterning device of another modification of the present invention.

FIG. 11 shows a modification of distribution device 38 of the second embodiment. A distribution device 47 is composed with a conductive brush **47*b* of rayon in which carbon is dispersed having a resistance of $10^{10}$ [Ωcm]. A voltage of 100 [V] is applied to conductive brush 47*b* by direct-current power source 47*a*, and conductive brush 47*b* is in sliding contact with photosensitive drum 18. By sliding contact conductive brush 47*b* with photosensitive drum 18, photosensitive drum 18 and residual toner 25*a* are discharged and, at the same time, the strewing of residual toner 25*a* is effected. Therefore, there is no need to provide any other discharge device. Incidentally, conductive brush 47*b* may also be a roller brush and its resistance may be such that any excess charge will flow from photosensitive drum 18 and residual toner 25*a*. Furthermore, even in this modification, a low voltage of the same polarity as that of residual toner 25*a* is applied to conductive brush 47*b* by direct-current power source 47*a* and so residual toner 25*a* does not adhere to conductive brush 47*b* but remains on photosensitive drum 18**. These distribution devices may be provided somewhere after image transferring and before developing, and anywhere will do as long as they do not disturb the electrostatic latent image.

A third embodiment of the present invention will be described hereinafter. If no description is given, the construction of the third embodiment is the same as that of the first and second embodiments.

Figure 12:
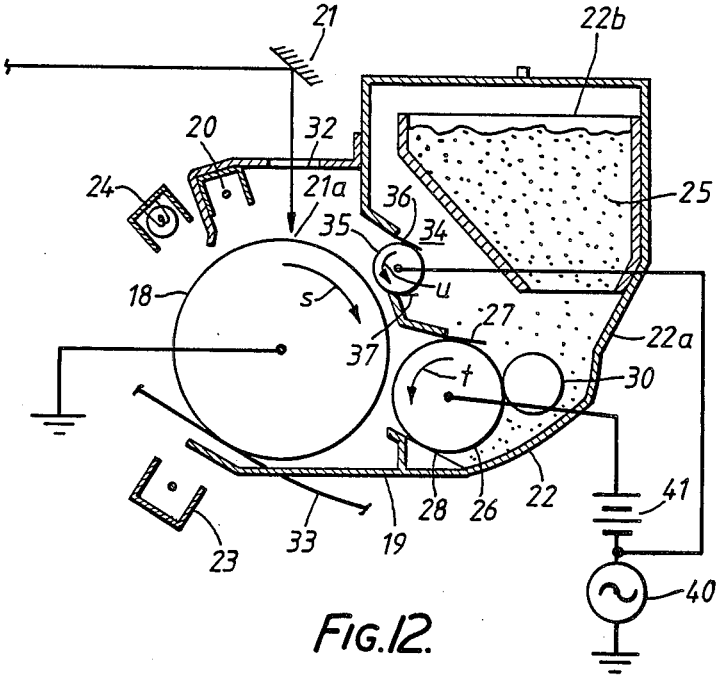

As shown in FIG. 12, main charger 20, exposure section **21*a*, a cleaning device 34 and developing device 22 are housed in unit 19. Also, cleaning device 34 and developing device 22 are provided in the same casing 22*a* which has toner hopper 22*b*. In cleaning device 34 there is a cleaning roller 35 in the upper opening of casing 22a. This cleaning roller 35 is 10 [mm] in diameter and is composed of an aluminium sleeve which is sand-blasted and electroless nickel-plated and has a surface roughness of 0.1–5 [μm] in order to increase its surface strength. Cleaning roller 35 is positioned so that there is a gap of 200 [μm] between it and photosensitive drum 18. Moreover, in developing device 22 there is developing roller 26 in the lower opening of casing 22a. This developing roller 22 is 16 [mm] in diameter and is composed of an aluminium sleeve which has been given the same surface treatment as cleaning roller 35. Developing roller 22 is positioned so that there is a gap of 250 [μm] between it and photosensitive drum 18. Also, sealing blades 36 and 37, which are made of 100 [μm] thick Mylor (trade name of Du Pont), is placed in contact with cleaning roller 35 to prevent toner from leaking from casing 22a. An alternating-current voltage of frequency 2 [KHz] and peak-to-peak 1.6 [KV] is applied across cleaning roller 35 and photosensitive drum 18 by alternating-current power source 40 only. At the same time, a direct-current voltage of +400 [V] and an alternating-current voltage of frequency 2 [KHz] and peak-to-peak 1.6 [KV] are superimposed and applied developing roller 26 and photosensitive drum 18 by direct-current power source 41 and alternating-current power source 40**.

Figure 13:
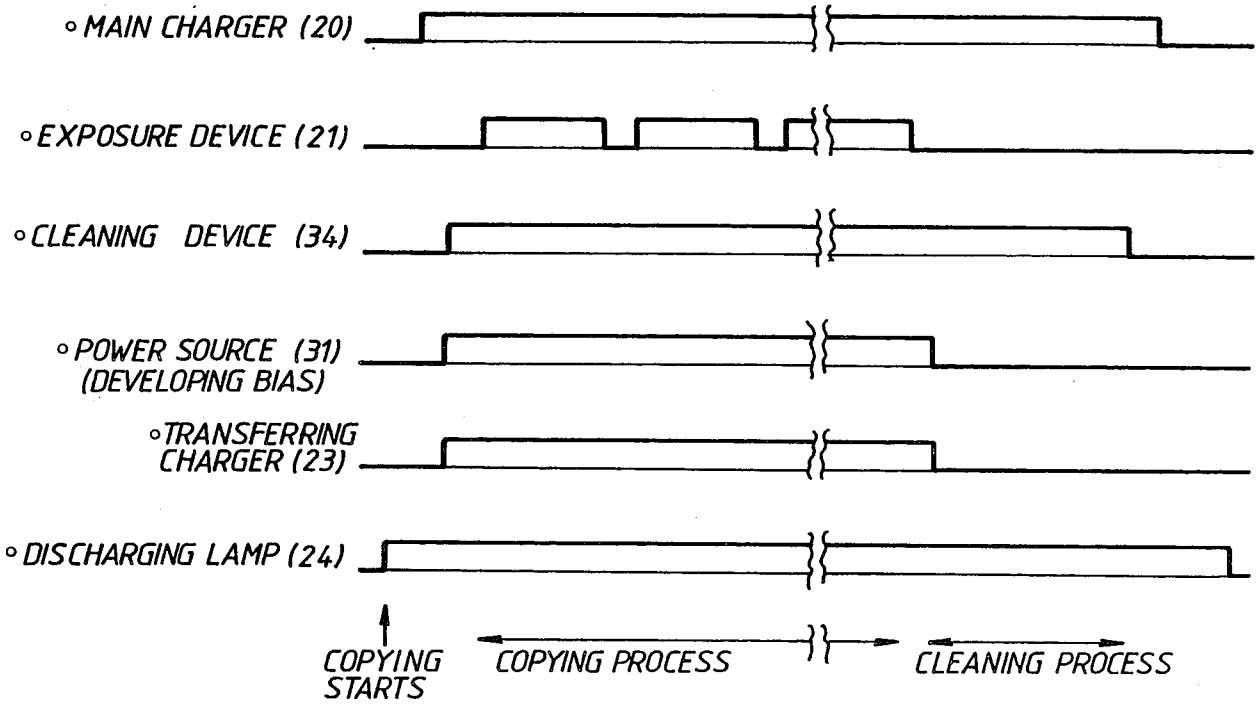
Figure 14:
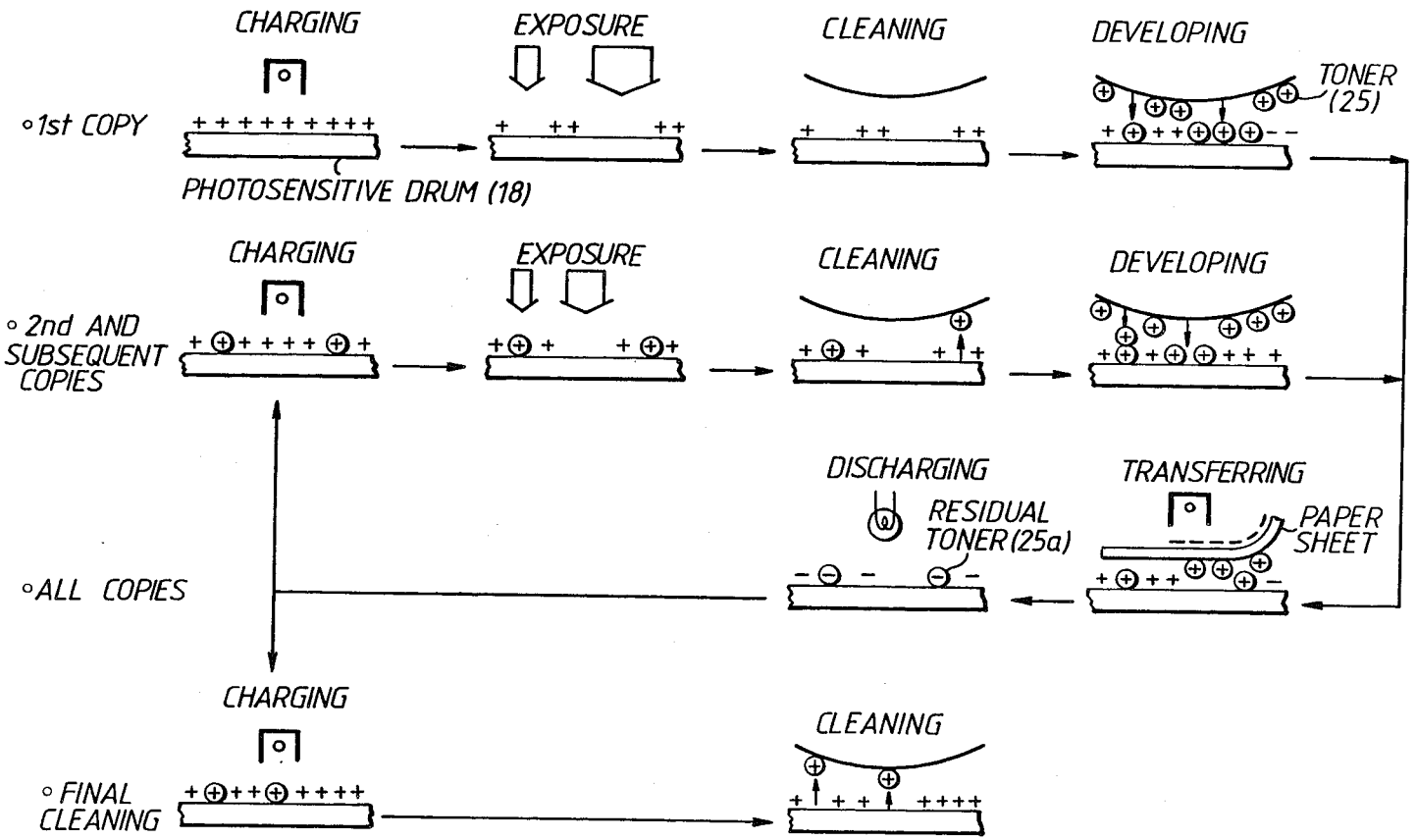
Figure 15:
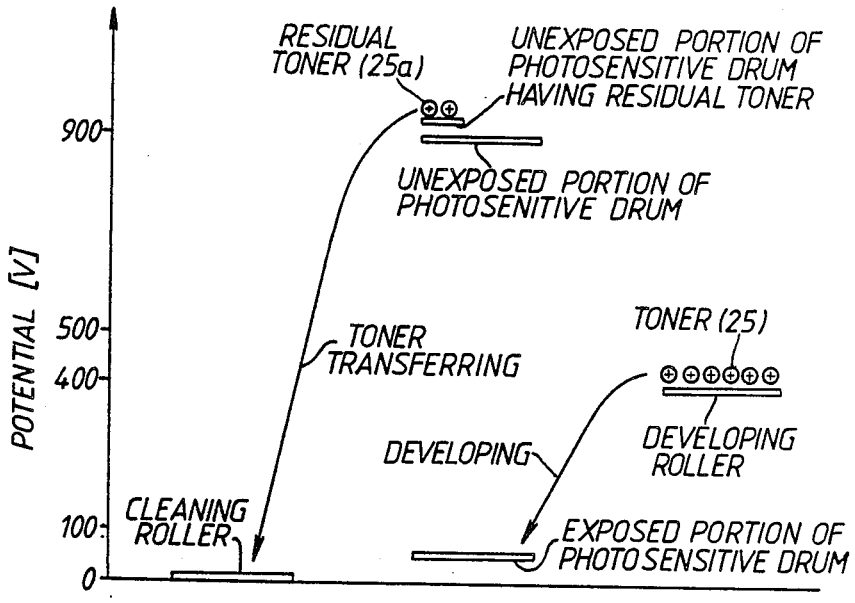

Next, the operation is described. As shown in the timing chart in FIG. 13, when copying is started, photosensitive drum 18 is rotated in the direction of arrow S in order to make the first copy and, at the same time, discharge lamp 24 is lit and each part of the image forming apparatus is operated. That is, as shown in FIG. 14, the surface of photosensitive drum 18 is uniformly charged with +900 [V] by main charger 20 while photosensitive drum 18 rotates. Then, at exposure section 21a, photosensitive drum 18 is exposed by the laser beam according to the image information, and the surface potential of the exposed areas of photosensitive drum 18 is reduced to +70 [V]. After this, when cleaning device 34 is reached, the alternating-current voltage of frequency 2 [KHz], 1.6 [KV] is applied by alternating-current power source 40 to cleaning roller 35 which is rotated in the direction of the arrow u. Since there is a direct-current potential difference of 900 [V] between the unexposed areas of photosensitive drum 18 and cleaning roller 35, as shown in FIG. 15, residual toner 28a on the unexposed areas of photosensitive drum 18 transfers to cleaning roller 31 via the gap and be collected into casing 22a. Then, when photosensitive drum 18 reaches developing device 22, developing roller 26 is rotated in the direction of arrow t and its surface is formed a thin layer of toner 25 by sliding contact with coating blade 27. At this time, the toner is charged with the same polarity as that of photosensitive drum 18, which in this case is positive, and a direct-current voltage of +400 [V] is applied across developing roller 26 and photosensitive drum 18 as a bias voltage and, at the same time, toner 25 is made ready to vibrate and transfer by applying of an alternating-current voltage. Moreover, since a potential difference is 330 [V] between the direct-current component of the bias voltage applied to developing roller 26 and the surface potential of the exposed areas of photosensitive drum 18 is sufficient for toner 25 to transfer from developing roller 26 to the exposed areas of photosensitive drum 18 via the gap, as a result, a developed image is formed on photosensitive drum 18. Next, the developed image on photosensitive drum 18 is transferred on to paper sheet 33 by transferring charger 23. After this, paper sheet 33 is discharged to the outside of the main body via the fixing device (not shown). At the same time, the whole surface of photosensitive drum 18 is irradiated by discharge lamp 24, the image forming process for the first copy is completed and the second copy is commenced. However, although some toner still remains on photosensitive drum 18 at this stage, this residual toner 25a is only about 10% of the toner amount when forming the developed image on photosensitive drum 18 and, even at the second copy stage, will cause no adverse effect on carrying out the charging and exposure processes. Consequently, as shown in FIG. 14, the whole surface of photosensitive drum 18, including the section where there is residual toner 25a, is uniformly charged to +900 [V] in the same way as for the first copy while photosensitive drum 18 rotates. Moreover, it is exposed at exposure section 21a in accordance with the image information. Regardless of whether there is any residual toner 25a or not, the surface potential of the unexposed areas is maintained at +900 [V] while, at the same time, the surface potential of the exposed areas is reduced to +70 [V]. This is because, at the time of exposure the laser beam irradiates thoroughly right through residual toner 25a and, at the same time, the excess charge which is given to residual toner 25a when charging leaks away due to reduction of the resistance of photosensitive drum 18 below residual toner 25a. Then, when photosensitive drum 18 reaches cleaning roller 35 in this state, there is a direct-current component potential difference of 900 [V] between the unexposed areas of photosensitive drum 18 and cleaning roller 31. Therefore, residual toner 25a on the unexposed areas of photosensitive drum 18 transfers to cleaning roller 31 via the gap and is collected into casing 22a by the rotation of cleaning roller 35. Thus, residual toner 25a on the unexposed areas of photosensitive drum 18 is cleaned off and fogging will not occur on the second copy image. Next, when photosensitive drum 18 reaches developing device 22, the potential difference between the direct-current component of the bias voltage applied to developing roller 26 and the surface potential of exposed areas on photosensitive drum 18 becomes 330 [V] in the same way as in the case of the first copy. Consequently, toner 25 on developing roller 26 is caused to transfer to the exposed areas of photosensitive drum 18 via the gap and thus developing of photosensitive drum 18 can be carried out. Furthermore, photosensitive drum 18 is discharged by discharge lamp 24 after image transferring has been carried out by transferring charger 23 in the same way as for the first copy, and copying of the next copy commences. After this, the above mentioned processes are repeated until the required number of copies have been made. When the last copy has been completed, as shown in FIG. 13, the operation of exposure device 21, developing device 22 and transferring charger 23 are stopped. However, main charger 20, cleaning device 34 and discharge lamp 24 continue to operate so that only cleaning of photosensitive drum 18 can be carried out. That is, as shown in FIG. 14, the surface of photosensitive drum 18 is charged uniformly with +900 [V] by main charger 20 while photosensitive drum 18 rotates. Next, since photosensitive drum 18 reaches cleaning device 34 without having been exposed, residual toner 25a on photosensitive drum 18 transfers to cleaning roller 35. Then, when photosensitive drum 18 passes discharge lamp 24, the whole process is completed and main charger 20, cleaning device 34, discharge lamp 24 and photosensitive drum 18 are stopped.

According to the third embodiment described above, removing of residual toner 25*a* on photosensitive drum 18 before developing can be carried out by cleaning device 34 even without providing a device exclusively for cleaning in a position opposite to the developing device 22. Thus, the degree of freedom in design is improved and miniaturisation and weight reduction of the apparatus can be more easily designed. At the same time, there is no hindrance to an exhaust passage for ozone products generated from main charger 20 and so, even when an OPC of negative polarity is used, there is no danger of deterioration of the OPC due to ozone products. Moreover, there is no requirement for disposal of removed toner in the cleaning device so that maintainability is improved. On the other hand, even in comparison with apparatuses which carry out the developing and cleaning processes simultaneously, differing optimum biases for cleaning and developing can be applied to cleaning roller 35 and developing roller 26 respectively, and so each process can be carried out correctly. Consequently, a sharp copy image can be obtained without the occurrence of the carrier transferring to the photosensitive body and without the risk of soiling of images, as in prior art. Moreover, cleaning device 34 and developing device 22 are provided in the same casing 22*a*. Thus, since residual toner 25*a* collected by cleaning roller 35 is dropped back into casing 22*a* and is used for developing, there is no need to dispose of the collected toner, and consequently maintainability is improved.

What is claimed is:

1. An image forming apparatus comprising:
an image carrier:
means for charging said image carrier;
means for exposing said image carrier to form a latent image thereon having exposed areas and unexposed areas;
means for developing said latent image, to form a developed image on said image carrier with a single-component developing agent, said developing means is provided so that there is a gap between it and said image carrier;
means for transferring said developed image onto a sheet-like material; and
means for applying a bias voltage across said developing means and image carrier to causes said developing agent to transfer from said developing means to the exposed areas of said latent image via said gap, and to causes the residual developing agent remaining on the unexposed areas of said image carrier after the developed image transferring by said transferring means to transfer to said developing means via said gap.

2. The apparatus according to claim 1, wherein said single-component developing agent comprises a non-magnetic material.

3. The apparatus according to claim 1, wherein said applying means applies a direct-current voltage with a superimposed alternating-current voltage.

4. The apparatus according to claim 1, further comprising:
means for distributing the residual developing agent remaining on said image carrier after the developed image transferring by said transferring means and before next image forming process.

5. The apparatus according to claim 4, wherein said distributing means includes:
a brush having electrically conductive fur which is brought into sliding contact with said image carrier; and
means for applying a direct-current voltage to said brush for preventing the residual developing agent from adhering to said brush.

6. The apparatus according to claim 5, wherein said distribution means further includes:
means for reducing the surface potential of said image carrier and the charge of the residual developing agent substantially to zero.

7. The apparatus according to claim 6, wherein said reducing means includes:
a discharge charger arranged near said image carrier and for applying an alternating-current voltage; and
a discharge lamp arranged near said image carrier to irradiate said image carrier.

8. An image forming apparatus comprising:
an image carrier;
means for charging said image carrier;
means for exposing said image carrier to form a latent image on said image carrier;
means for developing said latent image to form a developed image on said image carrier with a developing agent;
means for transferring said developed image onto a sheet-like material;
means for distributing the residual developing agent remaining on said image carrier after the transfer of the developed image and before the next image forming operation; and
means for removing residual developing agent remaining on said image carrier by causing transfer of the developing agent from said image carrier back to said developing means, said removing means being operated simultaneously with said developing means.

9. The apparatus according to claim 8, wherein said distributing means includes:
a brush having electrically conductive fur which is brought into sliding contact with said image carrier; and
a direct-current voltage applied to said brush for preventing residual developing agent from adhering to said brush.

10. The apparatus according to claim 9, wherein said distributing means further includes:
means for reducing the surface potential of said image carrier and the charge of the residual developing agent substantially to zero.

11. The apparatus according to claim 10, wherein said reducing means includes:
a discharge charger arranged near said image carrier, which is supplied with an alternating-current voltage; and
a discharge lamp arranged near said image carrier to irradiate said image carrier.

12. An image forming apparatus comprising:
an image carrier;
means for charging said image carrier;
means for exposing said image carrier to form a latent image on said image carrier;
a casing containing a single-component developing agent therein;

means for developing said latent image to form a developed image on said image carrier with said developing agent, said developing means being partially enclosed in said casing;

means for transferring said developed image onto a sheet-like material;

means for cleaning the residual developing agent remaining on said image carrier, said cleaning means being arranged in said casing and positioned between said exposing means and developing means;

first means for applying a bias voltage across said developing means and image carrier to cause said developing agent to transfer from said developing means to said latent image; and second means for applying a bias voltage across said cleaning means and image carrier to cause the residual developing agent remaining on said image carrier after the transfer of the developed image to transfer to said cleaning.

13. The apparatus according to claim 12, wherein said cleaning means is arranged so the developing agent transferred thereto is dropped back into said casing means.

14. The apparatus according to claim 12, wherein said developing means includes a developing roller spaced from said image carrier and said cleaning means includes a cleaning roller spaced from said image carrier.

15. The apparatus according to claim 14, wherein said casing includes a first opening in which said developing roller is provided and a second opening in which said cleaning roller is provided.

16. The apparatus according to claim 12, wherein said single-component developing agent comprises a non-magnetic material.

17. The apparatus according to claim 12, wherein said first applying means includes a direct-current voltage with a superimposed alternating voltage and second applying means includes an alternating-current voltage.

18. An image forming apparatus comprising:

means for forming an electrostatic latent image having an image area and a non-image area on an image carrier;

means, disposed in opposed relationship with said image carrier with a gap therebetween, for carrying a single-component developing agent thereon; and means for applying said single-component developing agent carried on said carrying means onto the image area of said electrostatic latent image across said gap so as to form the developed image and removing the residual developing agent remaining on the non-image area of said image carrier by causing back transition of the developing agent from said image carrier to said carrying means.

* * * * *